US012745819B2

(12) United States Patent
Shikahama

(10) Patent No.: US 12,745,819 B2
(45) Date of Patent: Sep. 29, 2026

(54) SOLE CONTACT BODY

(71) Applicant: SHIKAHAMA CO., LTD., Tokyo (JP)

(72) Inventor: Shigeru Shikahama, Tokyo (JP)

(73) Assignee: SHIKAHAMA CO., LTD., Tokyo (JP)

( * ) Notice: Subject to any disclaimer, the term of this patent is extended or adjusted under 35 U.S.C. 154(b) by 0 days.

(21) Appl. No.: 18/689,126

(22) PCT Filed: Dec. 13, 2021

(86) PCT No.: PCT/JP2021/045815
§ 371 (c)(1),
(2) Date: Mar. 5, 2024

(87) PCT Pub. No.: WO2023/037568
PCT Pub. Date: Mar. 16, 2023

(65) Prior Publication Data

US 2024/0381974 A1 Nov. 21, 2024

(30) Foreign Application Priority Data

Sep. 10, 2021 (WO) ..... PCT/JP2021/033262
Nov. 11, 2021 (WO) ..... PCT/JP2021/041531

(51) Int. Cl.
*A43B 7/1445* (2022.01)
*A43B 7/145* (2022.01)

(52) U.S. Cl.
CPC ..... *A43B 7/1445* (2013.01); *A43B 7/145* (2013.01)

(58) Field of Classification Search
CPC ..... A43B 7/1435; A43B 7/1445; A43B 7/145; A43B 7/1425
See application file for complete search history.

(56) References Cited

U.S. PATENT DOCUMENTS 2,089,384 A * 8/1937 Levitt ..... A43B 7/22 36/145
2,486,653 A * 11/1949 Hukill ..... A43B 7/1445 36/141

(Continued)

FOREIGN PATENT DOCUMENTS

DE 1235773 B * 3/1967
JP 10-179207 A 7/1998

(Continued)

OTHER PUBLICATIONS

International Search Report for corresponding International Application No. PCT/JP2021/045815 mailed Feb. 1, 2022.

(Continued)

*Primary Examiner* — Megan E Lynch
(74) *Attorney, Agent, or Firm* — Chrisman Gallo Tochtrop LLC

(57) ABSTRACT

The present invention provides a sole contact body for footwear such as a shoe, an athletic shoe, or a sandal. The sole contact body comprises a raised part which is configured to contact each of the second, third and fourth toes to lift the metatarsophalangeal and proximal interphalangeal joint positions thereof, and which is configured to fit between the first and fifth toes so as not to lift the first and fifth toes throughout the entire lengths thereof. The raised part is configured to have a first toe-side stepped surface that touches the side of the first toe closer to the tip of the first toe than the metatarsophalangeal joint position thereof, and a fifth toe-side stepped surface that touches the side of the fifth toe closer to the tip of the fifth toe than the metatarsophalangeal joint position thereof.

9 Claims, 22 Drawing Sheets

(56) References Cited

U.S. PATENT DOCUMENTS

| | | | | | |
|---|---|---|---|---|---|
| 3,841,005 | A * | 10/1974 | Cox | A43B 13/42 | 36/76 C |
| 4,033,054 | A * | 7/1977 | Fukuoka | A43B 7/146 | 601/134 |
| 4,631,841 | A * | 12/1986 | Hickey | A43B 7/1415 | 36/43 |
| 4,803,989 | A * | 2/1989 | Collins | A43B 7/1445 | 36/154 |
| 2004/0010945 | A1* | 1/2004 | Eriksen | A43B 7/1425 | 36/180 |
| 2006/0000120 | A1* | 1/2006 | Chenut | A43B 7/1464 | 36/144 |
| 2006/0254092 | A1* | 11/2006 | Stevens | A43B 17/023 | 36/71 |
| 2010/0132222 | A1* | 6/2010 | Kawahara | A61F 5/14 | 36/43 |
| 2010/0269371 | A1* | 10/2010 | Gray | A43B 7/141 | 36/43 |
| 2014/0259755 | A1* | 9/2014 | Tsai | A43B 7/1415 | 36/43 |
| 2015/0000158 | A1* | 1/2015 | Wang | A43B 17/02 | 36/43 |
| 2018/0042335 | A1* | 2/2018 | Lan | A43B 7/145 | |
| 2018/0103717 | A1* | 4/2018 | Tsai | A43B 7/144 | |
| 2018/0200099 | A1* | 7/2018 | Hanft | A61F 5/0111 | |
| 2021/0274885 | A1* | 9/2021 | Billah | A43B 7/144 | |

FOREIGN PATENT DOCUMENTS

| | | | | |
|---|---|---|---|---|
| JP | 2007-175532 | A | 7/2007 | |
| JP | 2012-223321 | A | 11/2012 | |
| JP | 5364797 | B | 12/2013 | |
| KR | 101325038 | B1 * | 11/2013 | |
| WO | WO-2011059045 | A1 * | 5/2011 | A43B 17/006 |

OTHER PUBLICATIONS

Written Opinion for corresponding International Application No. PCT/JP2021/045815 dated Feb. 1, 2022.

* cited by examiner

SOLE CONTACT BODY

CROSS-REFERENCE TO RELATED APPLICATIONS

This application is a national stage entry of International Application No. PCT/JP2021/045815 filed on Dec. 13, 2021, which claims the benefit of priority to International Application No. PCT/JP2021/033262 filed on Sep. 10, 2021 and International Application No. PCT/JP2021/041531 filed on Nov. 11, 2021, the entire disclosures of which are hereby incorporated herein by reference.

TECHNICAL FIELD

The present disclosure relates to improvements in a sole contact body for footwear such as shoes, athletic shoes, sandals, etc., the sole contact body being suitable for correction of hallux valgus and digitus quintus varus.

BACKGROUND ART

Patent literature 1 discloses a sock lining for high heels. The sock lining disclosed in Patent literature 1 includes a transverse front raised part corresponding to a toe portion of a foot. Patent literature 1 describes that increasing the load surface of the toes can prevent the toes from tilting to the sides and thereby prevent foot distortion, which is a factor of hallux valgus.

However, the sock lining disclosed in Patent literature 1 only prevents foot distortion associated with wearing high heels.

Patent literature 2 also discloses a sock lining for high heel shoes. The sock lining disclosed in Patent literature 2 includes a raised part for forming a transverse arch and recesses for accommodating the balls (metatarsophalangeal joints/tissue under the MTP joints) of the first and fifth toes (see FIGS. 1A and 1B and paragraph [0027] in Patent literature 2).

In Patent literature 2, the toe side of the first and fifth toes relative to the balls is lifted by the raised part. Therefore, the sock lining of Patent literature 2 cannot apply a correction force to the first and fifth toes toward the medial and lateral foot sides, respectively, on the toe side relative to the first-toe-balls of the first and fifth toes.

CITATION LIST

Patent Literature

Patent Literature 1: Japanese Patent No. 5364797
Patent Literature 2: Japanese Patent Application Publication No. 2012-223321

SUMMARY OF THE INVENTION

Technical Problem

A main problem to be solved by the present disclosure is providing a sole contact body capable of correcting a collapse of the transverse arch of a foot and restoring the transverse arch of the foot to its normal state to correct hallux valgus and digitus quintus varus effortlessly, naturally and effectively through wearing footwear in daily life.

Solution to the Problem

To solve the problem above, according to the present disclosure, a sole contact body for use in footwear such as a shoe, an athletic shoe, and a sandal includes a raised part. The raised part is configured to contact each of second, third, and fourth toes and lift the second, third, and fourth toes at positions of metatarsophalangeal joints and proximal interphalangeal joints thereof, and is configured to fit between a first toe and a fifth toe so as not to lift the first toe and the fifth toe over entire lengths thereof. The raised part includes a first-toe-side step surface configured to contact a side portion of the first toe on a tip side relative to a position of a metatarsophalangeal joint thereof; and a fifth-toe-side step surface configured to contact a side portion of the fifth toe on a tip side relative to a position of a metatarsophalangeal joint thereof.

In the configuration above, the positions of the metatarsophalangeal joints and proximal interphalangeal joints of the second to fourth toes can be lifted. On the other hand, the raised part is not present under the first and fifth toes, so that the first and fifth toes are not lifted over their entire length. Since the length of the ligament at the metatarsophalangeal joints does not change, the first toe is pulled toward a lateral foot side at its metatarsophalangeal joint, and the fifth toe is pulled toward a medial foot side at its metatarsophalangeal joint.

By lifting the second to fourth toes not only at the positions of their metatarsophalangeal joints but also at the positions of their proximal interphalangeal joints, a leverage-like force that lifts the second to fourth toes on a tip side relative to their metatarsophalangeal joints can be applied to the metatarsophalangeal joint side of the second to fourth toes, causing a more effective change to the ligament.

Thus, a normal transverse arch of the foot can be effectively produced.

A correction force acting on the fifth toe synergistically acts as a correction force on the first toe, achieving effective correction of hallux valgus. On the tip side relative to the metatarsophalangeal joints, the first-toe-side step surface contacts a side portion of the first toe and applies a correction force to the first toe toward the medial foot side, and the fifth-toe-side step surface contacts a side portion of the fifth toe and applies a correction force to the fifth toe toward the lateral foot side. These also contribute to correction of hallux valgus and digitus quintus varus.

According to an aspect of the disclosure, the sole contact body further includes a space formed on a medial foot side of the raised part, in which the first toe is accommodated without being lifted; and a space formed on a lateral foot side of the raised part, in which the fifth toe is accommodated without being lifted.

According to an aspect of the disclosure, in the sole contact body, the first-toe-side step surface is formed so as to extend along a virtual vertical plane that intersects a virtual horizontal plane at an angle of 90 degrees to 60 degrees toward a center side of the raised part, the horizontal plane including left and right base portions of the raised part; and the fifth-toe-side step surface is formed so as to extend along a virtual vertical plane that intersects the horizontal plane at an angle of 90 degrees to 60 degrees toward the center side.

According to an aspect of the disclosure, the first-toe-side step surface has a maximum height of 8 mm to 11 mm, and the fifth-toe-side step surface has a maximum height of 4 mm to 7 mm.

According to an aspect of the disclosure, the first-toe-side step surface and the fifth-toe-side step surface contact the side portion of the first toe and the side portion of the fifth toe on the tip side, respectively, in an area at least part of which is gently curved toward a center side of the raised part.

According to an aspect of the disclosure, the sole contact body further includes a toe-side slope that contacts with the second, third, and fourth toes on a tip side. With this configuration, since the toe-side slope is present under the tips of the second to fourth toes, the toe side of the second to fourth toes is not in a floating state but is in a state where they can hold the toe-side slope firmly even when the second to fourth toes are lifted at the positions of their metatarsophalangeal joints and proximal interphalangeal joints as described above. The inventor has found that by enabling the lifted second to fourth toes to hold firmly as described above, a transverse arch in which the first toe and the fifth toe are at lower positions can be effectively produced.

According to an aspect of the disclosure, a portion of the raised part on a rear side relative to the toe-side slope is configured to gradually decrease in height and left-right width toward the rear side.

According to an aspect of the disclosure, the sole contact body further includes a ridge-like part formed at a position directly above the first-toe-side step surface, the ridge-like part protruding from an upper surface of the raised part and extending in a front and rear direction.

According to an aspect of the disclosure, the ridge-like part has a width of 3 mm to 8 mm and protrudes from the upper surface of the raised part by 5 mm to 9 mm.

According to an aspect of the disclosure, a side surface of the ridge-like part facing a medial foot side is flush with the first-toe-side step surface.

Advantageous Effects of the Invention

According to the present disclosure, it is possible to correct a collapse of the transverse arch of a foot and restore the transverse arch to its normal state effortlessly, naturally and effectively through wearing footwear provided with the sole contact body in daily life, thereby correcting hallux valgus and digitus quintus varus.

DESCRIPTION OF THE INVENTION

Hereinafter, a typical embodiment of the present disclosure will be described based on FIG. 1 to FIG. 22. FIGS. 1 to 11 illustrate a first example of a sole contact body 1. FIGS. 12 to 18 illustrate a second example of the sole contact body 1.

The sole contact body 1 according to the embodiment serves as a part of footwear such as a shoe, athletic shoe, sandal, etc., that comes into contact with the sole of a foot, or a member that comes into contact with the sole of a foot when additionally combined with such footwear. Typically, the sole contact body 1 serves as an insole or an inner sole (a sock lining). The sole contact body 1 has a function to correct a collapse of the transverse arch Ac of a foot and restore the transverse arch Ac to its normal state as illustrated in FIG. 20 effortlessly, naturally and effectively through wearing footwear provided with the sole contact body 1 in daily life.

Figure 19:
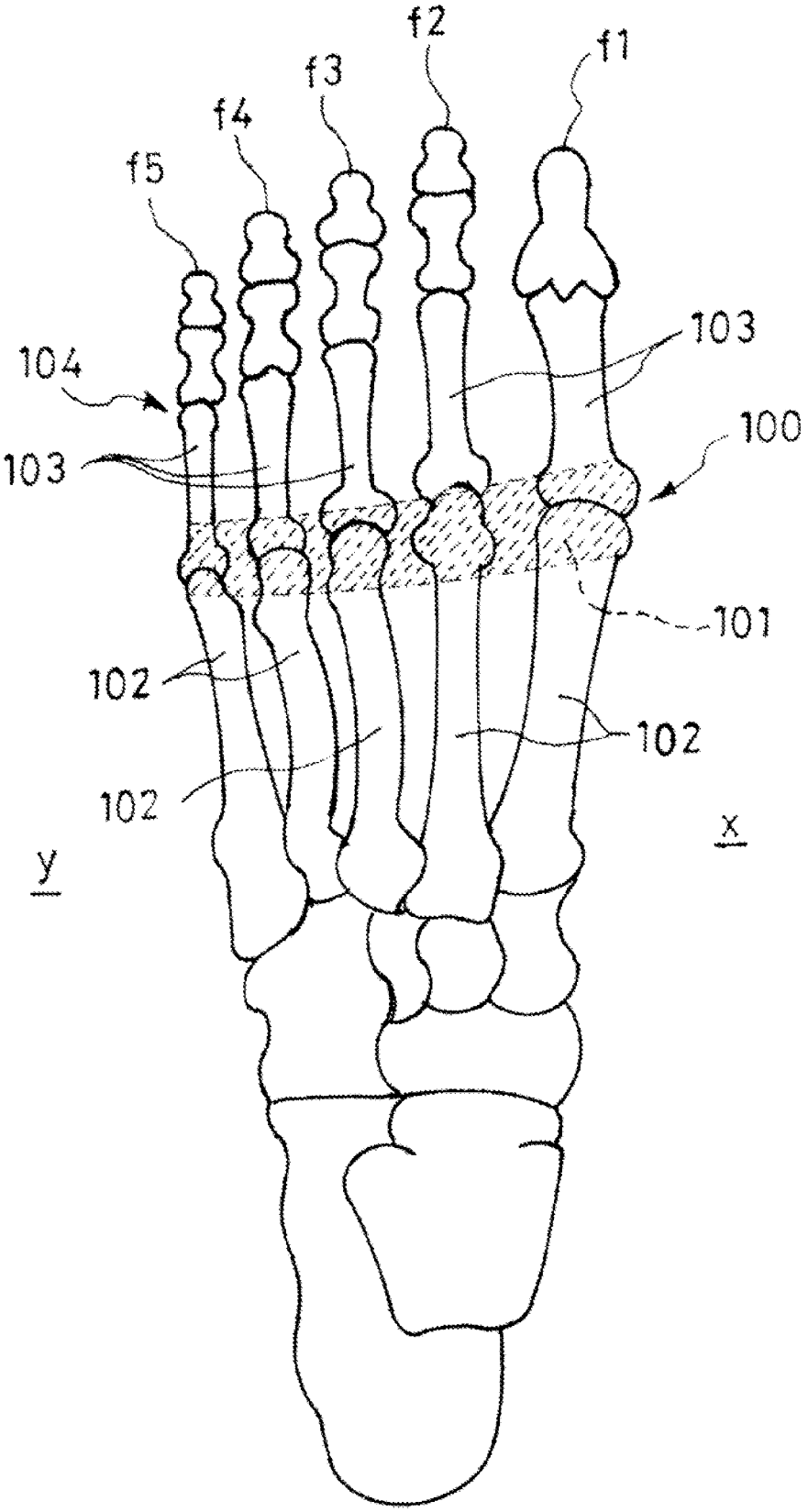
FIG. 19 is a plan configuration diagram illustrating the bone structure of a normal left foot.

FIG. 19 illustrates the bone structure of a normal left foot. A ligament 101 (a deep transverse metatarsal ligament 101) connecting adjacent metatarsi 102 is located at the positions of the metatarsophalangeal joints 100 (MTP joints) of a first toe f1 to a fifth toe f5. In a normal state, the transverse arch Ac is formed at the position of the ligament 101 as illustrated in FIG. 20.

Figure 20:
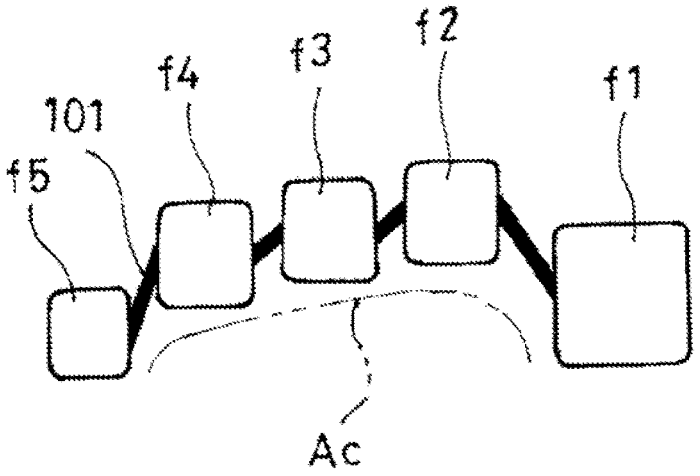
FIG. 20 is a cross-sectional configuration diagram at the positions of the metatarsophalangeal joints of a normal left foot.

That is, even when the first toe f1 and the fifth toe f5 touch the ground, the second toe f2 to the fourth toe f4 are in a floating state at the positions of their metatarsophalangeal joints 100, with the second toe f2 at the highest position and the fourth toe f4 at the lowest position (FIG. 20).

Figure 21:
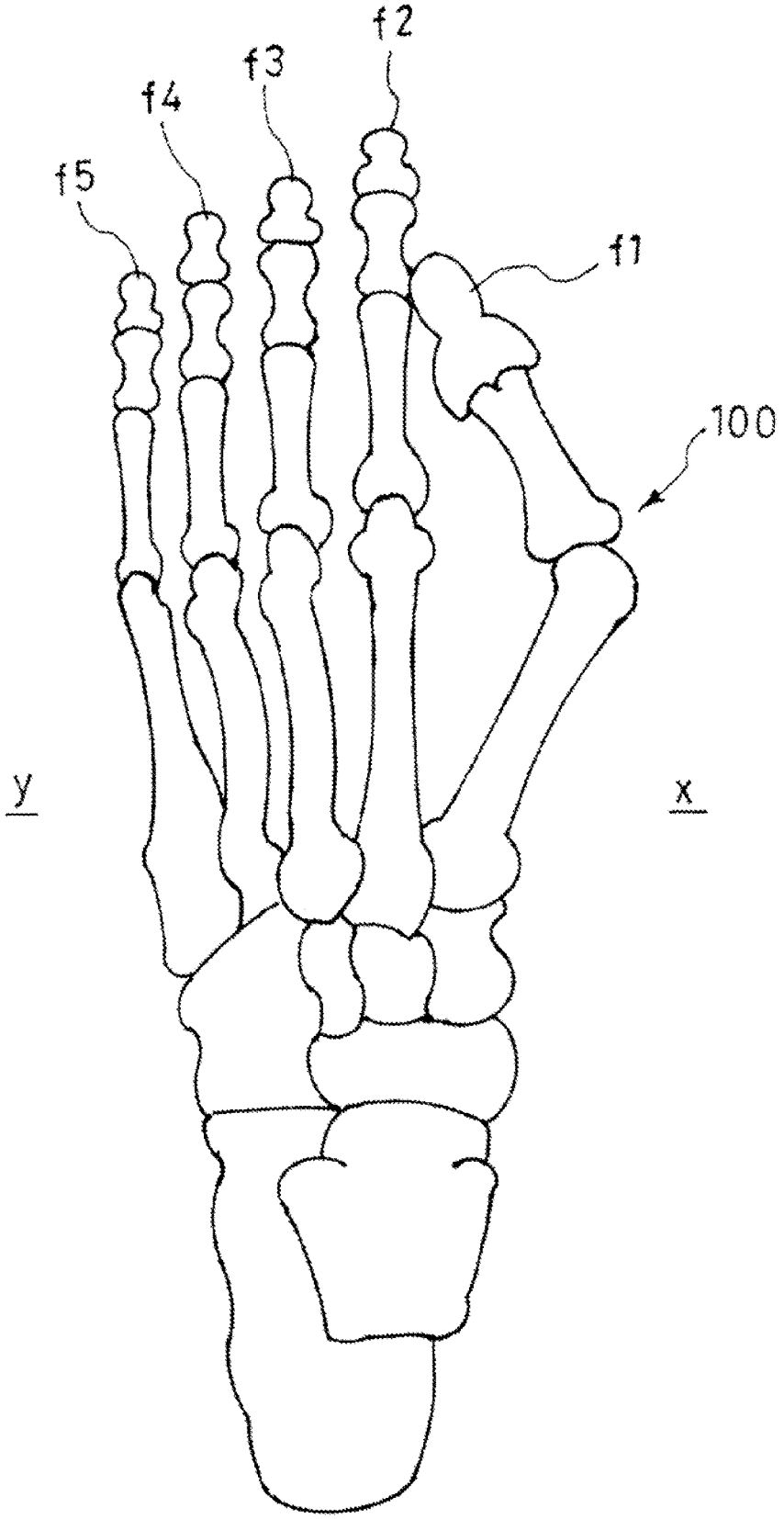
FIG. 21 is a plan configuration diagram illustrating the bone structure of a left foot with hallux valgus.
Figure 22:
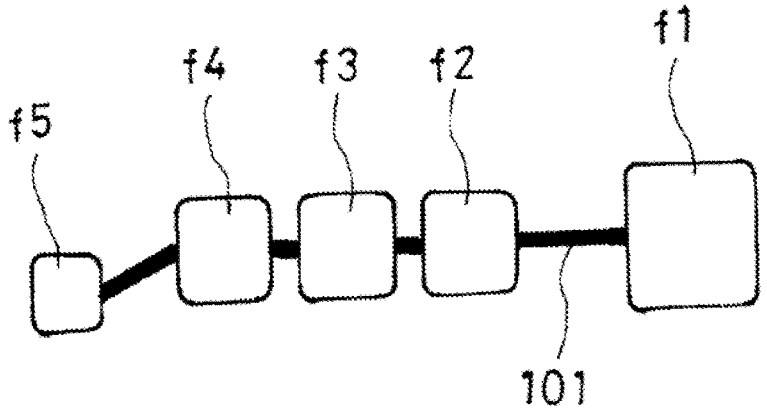
FIG. 22 is a cross-sectional configuration diagram at the positions of the metatarsophalangeal joints of a left foot with hallux valgus.

FIG. 21 illustrates the bone structure of a left foot with hallux valgus. As illustrated in FIG. 22, the transverse arch Ac is lost; the metatarsophalangeal joint 100 of the first toe f1 protrudes toward a medial foot side x (right foot side); and a tip side of the first toe f1 is located on a lateral foot side y compared to a normal left foot. The first toe f1 to the fifth toe f5 are positioned at the same height, and the width of the foot is wider due to the deformity of the first toe f1.

Typically, hallux valgus often progresses as follows:

(1) The transverse arch Ac of a foot collapses, resulting in a splayed foot.

(2) The metatarsus 102 of the first toe F1 becomes deformed toward the medial foot side x.

(3) By wearing footwear with a narrowed toe side such as high heels, the proximal phalanx 103 of the first toe F1 becomes deformed toward the lateral foot side y, contributing the progress of the deformity of the metatarsus 102 of the first toe F1 toward the medial foot side x.

Although not illustrated in the drawings, digitus quintus varus is a state in which the transverse arch Ac is lost; the metatarsophalangeal joint 100 of the fifth toe f5 protrudes toward the lateral foot side y; and a tip side of the fifth toe f5 is positioned on the medial foot side x, compared to a normal foot.

The sole contact body 1 according to the present embodiment has a function that can effectively correct hallux valgus and digitus quintus varus at the same time.

The sole contact body 1 includes a raised part 2. The sole contact body 1 is typically composed of rubber or plastic having rubbery elasticity.

In the illustrated example, the sole contact body 1 is configured by integrally forming a raised-part component 2*a*, which becomes the raised part 2, on an upper surface 3*a* of a base part 3 shaped so as to conform with the outline of the inside of footwear.

Although not illustrated in the drawings, the sole contact body 1 may also be configured by fixing a bottom surface of the raised-part component 2*a*, which becomes the raised part 2, on an upper surface of a base plate shaped so as to conform with the outline of the inside of footwear.

Further, the sole contact body 1 may also be configured by fixing the above-mentioned raised-part component 2*a* on an upper surface of the insole of existing footwear or an existing sandal.

The raised part 2 is configured to contact each of the second toe f2, the third toe f3, and the fourth toe f4 to lift the positions of their metatarsophalangeal joints 100 and proximal interphalangeal joints 104 (PIP joints), and is configured to fit between the first toe f1 and the fifth toe f5 so as not to lift the first toe f1 and the fifth toe f5 over their entire length. That is, as will be described later, the raised part 2 is configured to have a height and shape that enable a foot to have a normal transverse arch Ac (see FIG. 20).

Figure 1:
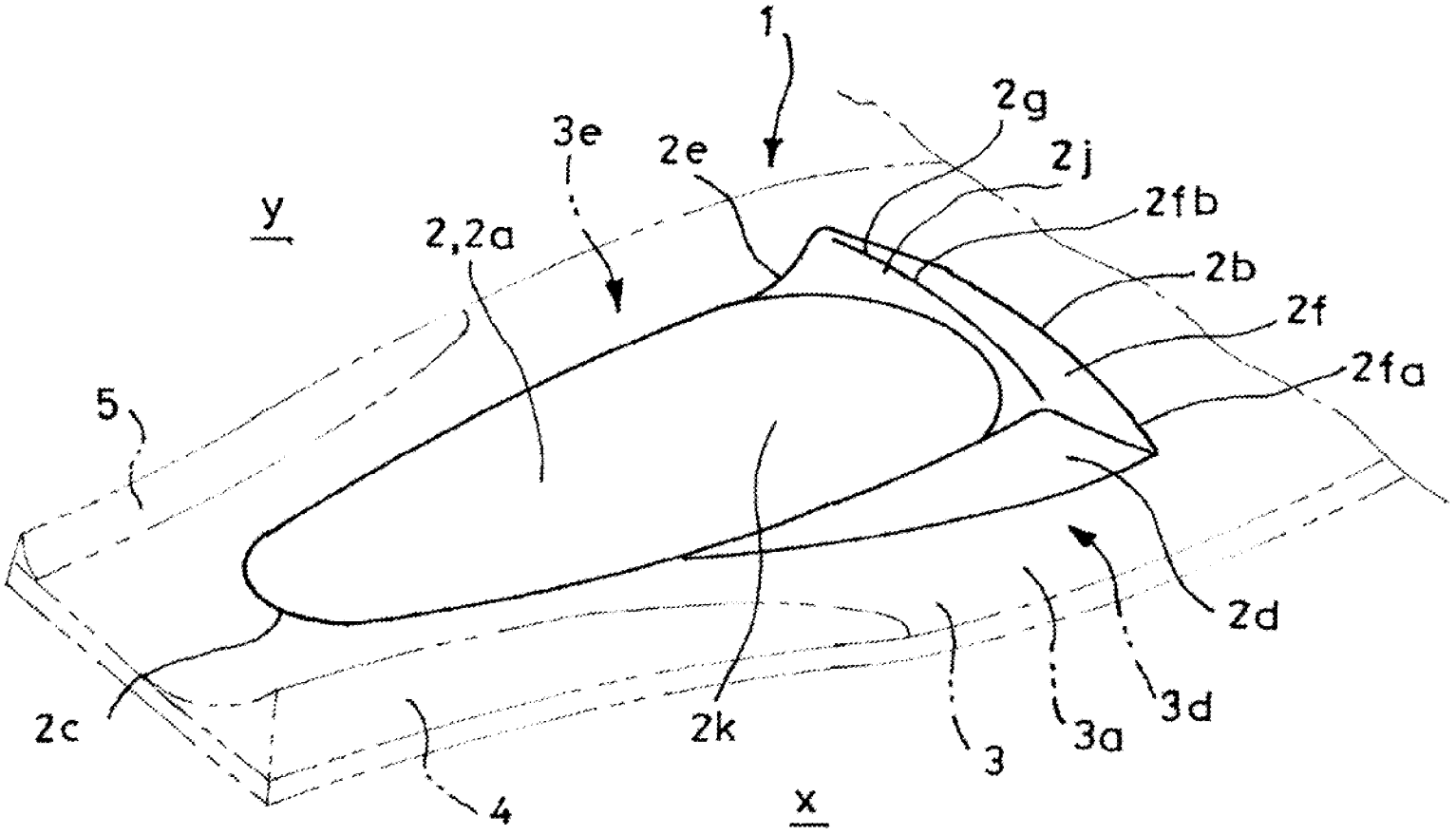
FIG. 1 is a perspective configuration diagram of a sole contact body (a first example) according to an embodiment of the present disclosure, in which a raised part is illustrated in solid lines and a main portion of a base part is illustrated in imaginary lines.
Figure 2:
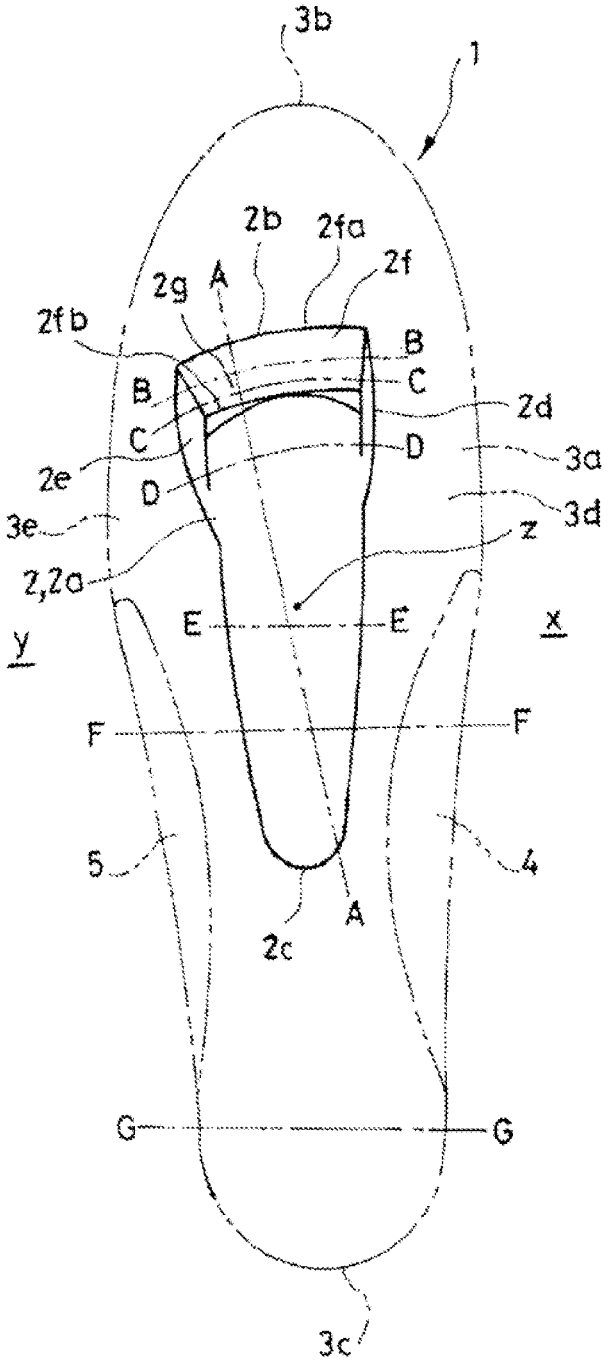
FIG. 2 is a plan configuration diagram of the first example, in which the raised part is illustrated in solid lines and the base part is illustrated in imaginary lines.
Figure 3:
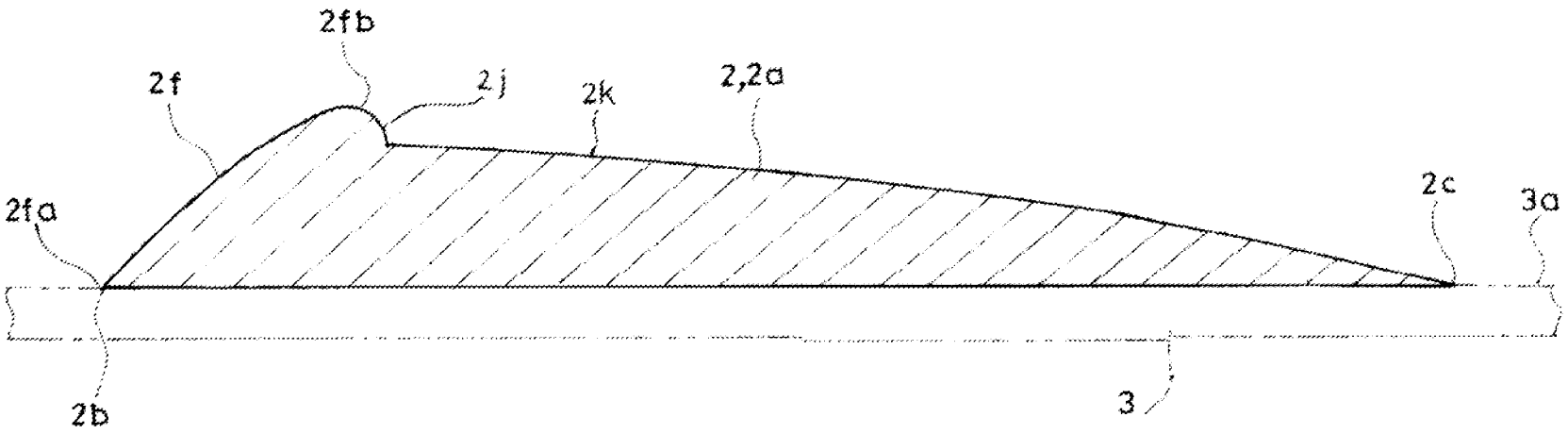
FIG. 3 is a configuration diagram of a cross section cut at the A-A line in FIG. 2.

FIGS. 1 and 2 illustrate the raised part 2 constituting the sole contact body 1 for a left foot. In the illustrated example, the raised part 2 is formed so as to extend in a front and rear direction at a position midway in a left and right direction of the base part 3 with a space between a front end 3*b* (the toe side) of the base part 3 and a front end 2*b* of the raised part 2 and with a space between a rear end 3*c* (the heel side) of the base part 3 and a rear end 2*c* of the raised part 2.

Further, a space 3*d* is formed between a side of the raised part 2 on the medial foot side x and an edge of the base part 3 on the medial foot side x to accommodate the first toe, and a space 3*e* is formed between a side of the raised part 2 on the lateral foot side y and an edge of the base part 3 on the lateral foot side y to accommodate the fifth toe.

That is, in the present embodiment, a space in which the first toe f1 is accommodated without being lifted and a space in which the fifth toe f5 is accommodated without being lifted are formed on the medial foot side x and on the lateral foot side y, respectively, with the raised part 2 placed therebetween.

In the illustrated example, the base part 3 is further provided with a medial auxiliary raised part 4 corresponding to the medial longitudinal arch of a foot and a lateral auxiliary raised part 5 corresponding to the lateral longitudinal arch of the foot.

Figure 9:
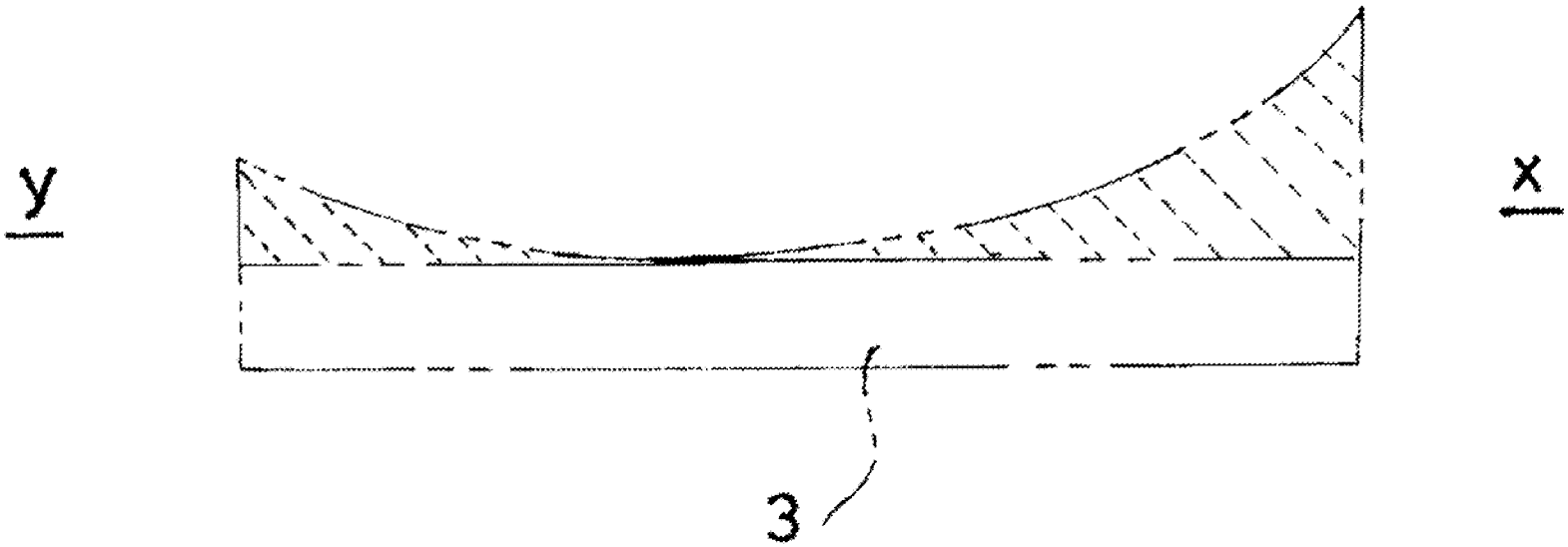
FIG. 9 is a configuration diagram of a cross section cut at the G-G line in FIG. 2.

The rear end 3*c*, i.e., the heel side of the base part 3 preferably has a shape in which the medial foot side x is high and the lateral foot side y is low, as illustrated in FIG. 9. As illustrated in FIG. 19, the calcaneus is located on the lateral foot side y; and on the heel side of a foot, part of tissue on the medial foot side x is not supported by a bone. The configuration illustrated in FIG. 9 can prevent foot deformity due to the morphology of the calcaneus.

According to the present embodiment, the raised part 2 includes: a first-toe-side step surface 2*d* configured to contact a side portion of the first toe f1 on a tip side relative to the position of the metatarsophalangeal joint 100 of the first toe f1; a fifth-toe-side step surface 2*e* configured to contact a side portion of the fifth toe f5 on a tip side relative to the position of the metatarsophalangeal joint 100 of the fifth toe f5; and a toe-side slope 2*f* configured to contact ventral sides of the second toe f2, the third toe f3, and the fourth toe f4 on a tip side.

A slope lower end 2*fa* of the toe-side slope 2*f* is identical with the front end 2*b* of the raised part 2. A portion of the raised part 2 on the rear side relative to a slope upper end 2*fb* of the toe-side slope 2*f* is configured to gradually decrease in height and left-right width of the raised part 2 toward the rear end 2*c* of the raised part 2.

Figure 10:
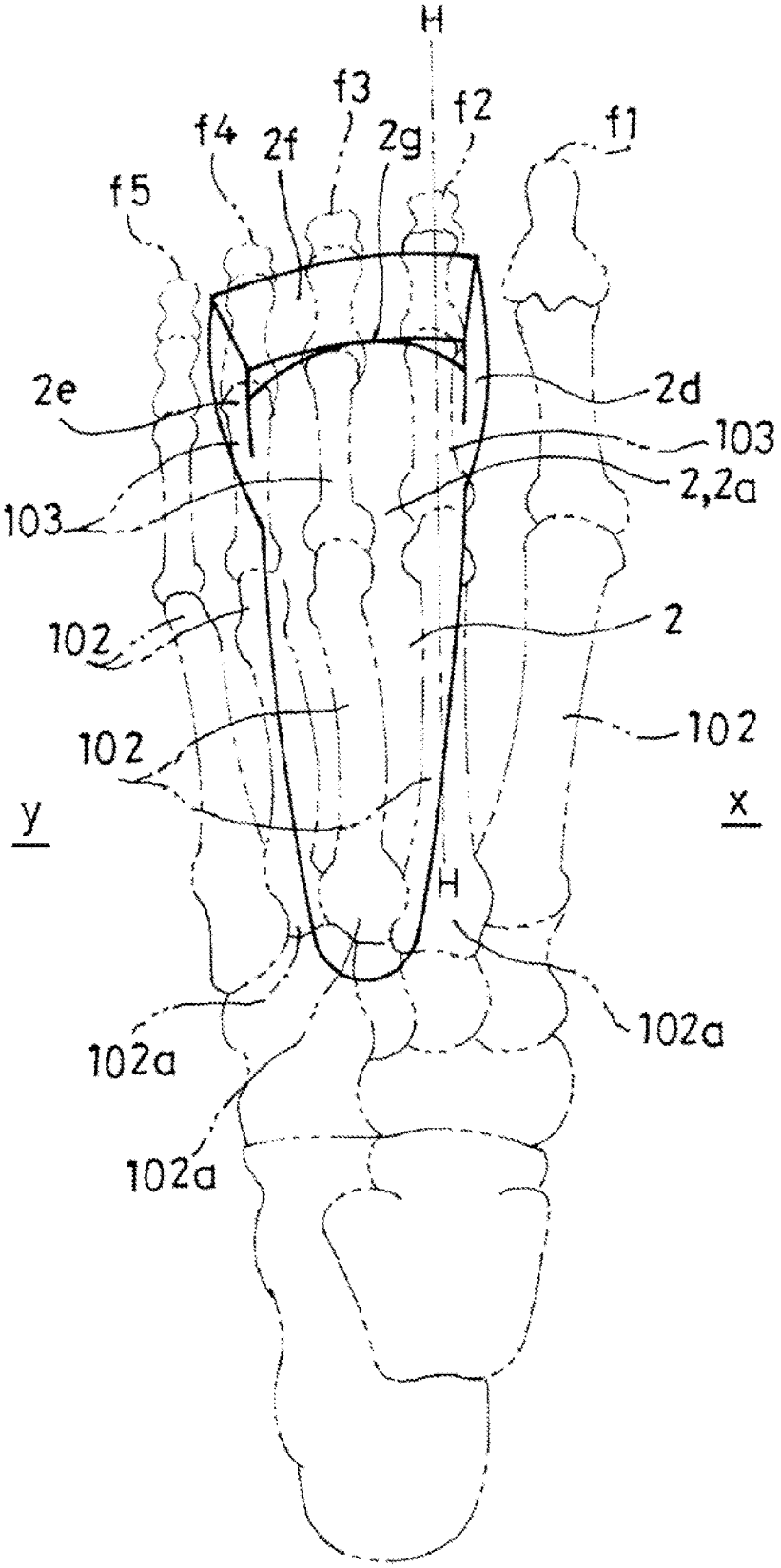
FIG. 10 is a plan configuration diagram illustrating the raised part and the skeleton of a left foot together for ease of understanding of features of the first example.
Figure 11:
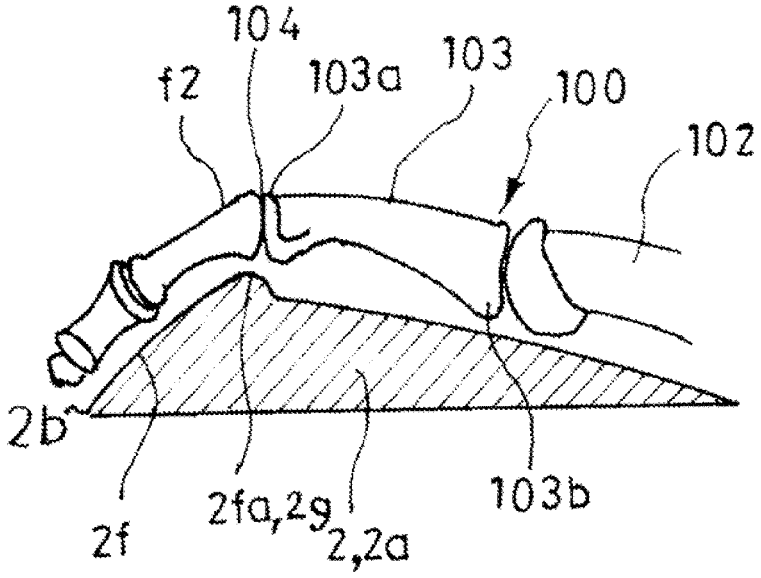
FIG. 11 is a configuration diagram of a cross section cut at the H-H line in FIG. 10.
Figure 12:
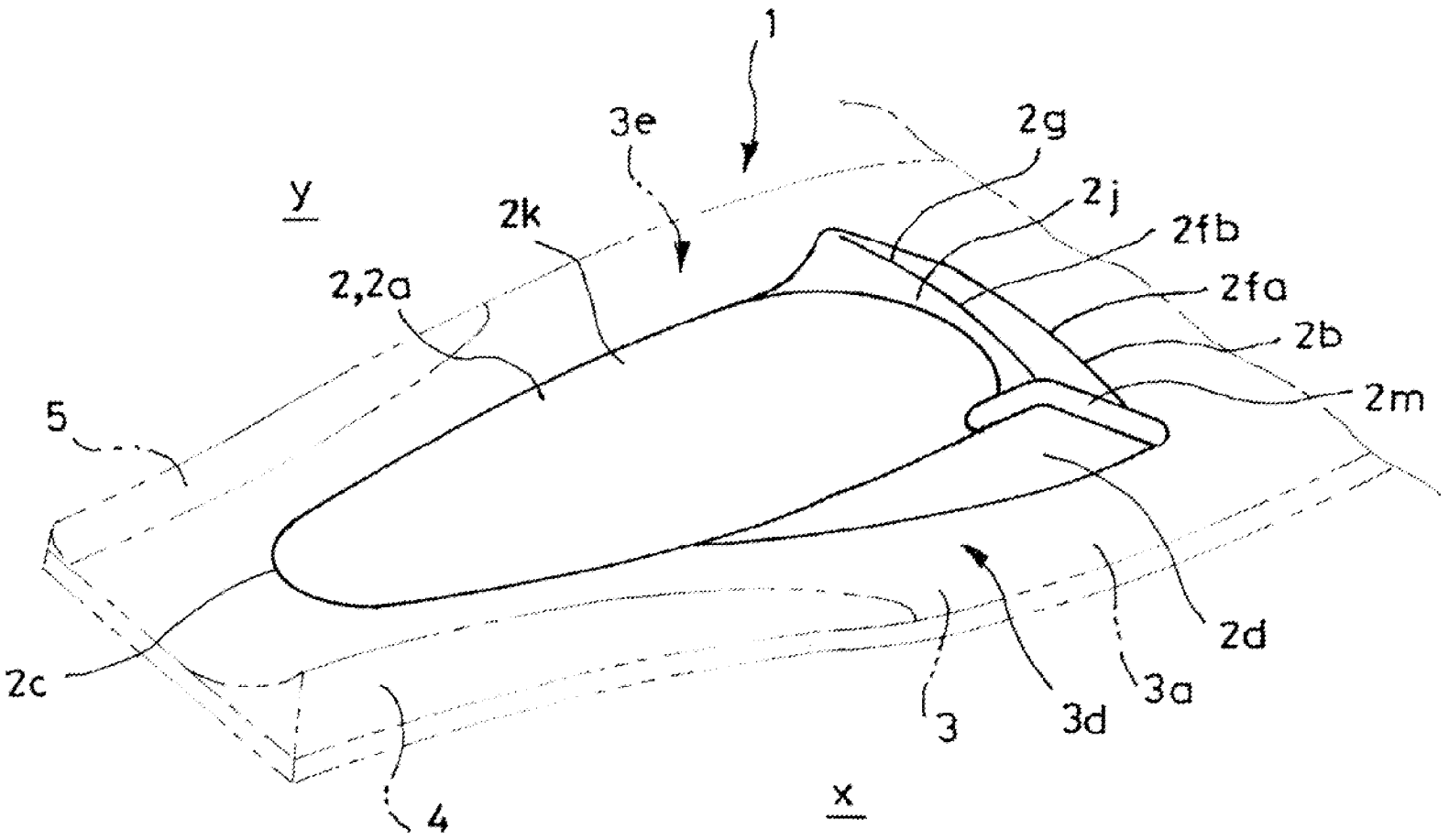
FIG. 12 is a perspective configuration diagram of a sole contact body (a second example) according to the embodiment of the present disclosure, in which a raised part is illustrated in solid lines and a main portion of a base part is illustrated in imaginary lines.
Figure 13:
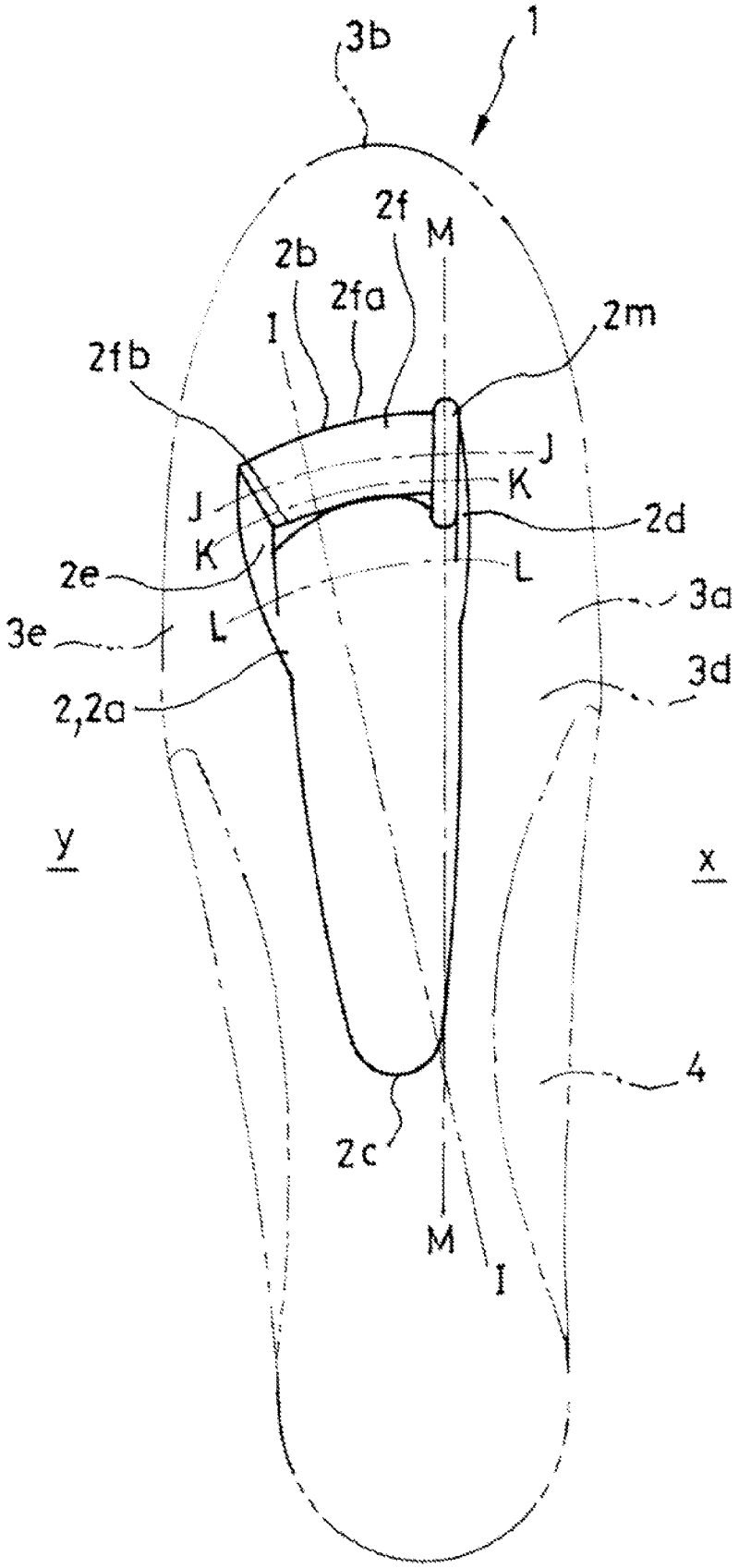
FIG. 13 is a plan configuration diagram of the second example, in which the raised part is illustrated in solid lines and the base part is illustrated in imaginary lines.
Figure 14:
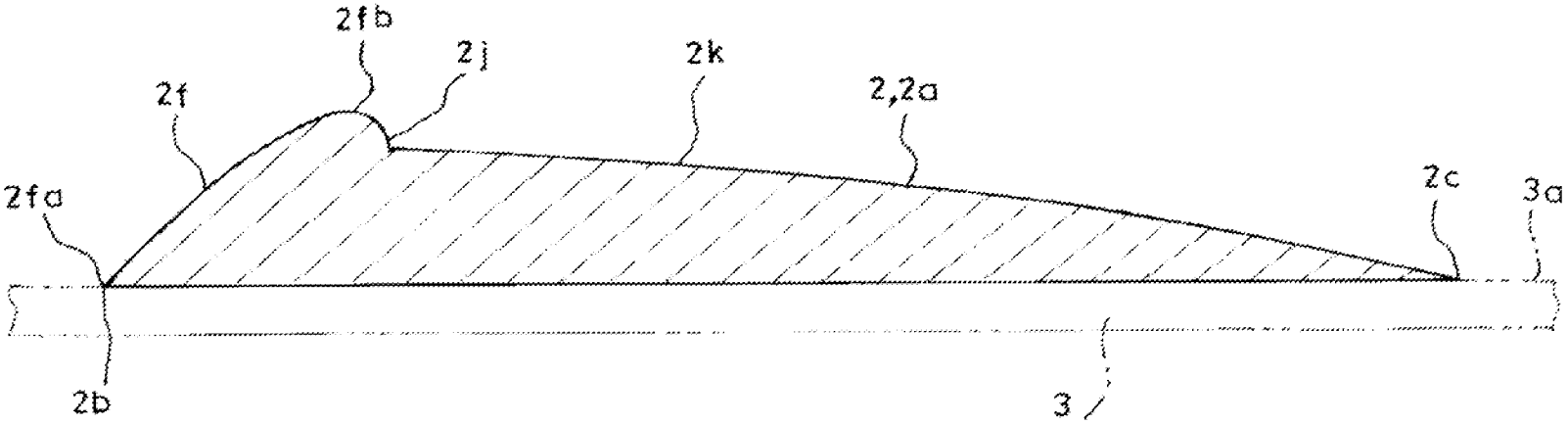
FIG. 14 is a configuration diagram of a cross section cut at the I-I line in FIG. 13.

As shown in FIGS. 10 and 11, when a foot is placed on the sole contact body 1, the front end 2*b* of the raised part 2 is located under the tips of the second toe f2 to the fourth toe f4; the slope upper end 2*fb* of the toe-side slope 2*f* of the raised part 2 is located under anterior ends 103*a* of the proximal phalanxes 103 of the second toe f2 to the fourth toe f4; and the rear end 2*c* of the raised part 2 is located under posterior ends 102*a* of the metatarsi 102 of the second toe f2 to the fourth toe f4.

On the front end 2*b* side of the raised part 2, a ridgeline 2*g* extending in the left and right direction is formed by the slope upper end 2*fb* of the toe-side slope 2*f*. The front end 2*b* side of the raised part 2 is highest at the position of the ridgeline 2*g*. Formed between the front end 2*b* of the raised part 2 and the ridgeline 2*g* is the toe-side slope 2*f* extending along the left and right direction. In the illustrated example, the toe-side slope 2*f* forms a curved surface with the below side being the inside of the curve (see FIG. 3). Immediately behind the ridgeline 2*g* is a small step 2*j* facing the rear side. Formed between the step 2*j* and the rear end 2*c* of the raised part 2 is an upper surface 2*k* of the raised part 2, which is a gently sloping surface.

The dimension in the left and right direction on the front end 2*b* side of the raised part 2 is set to be substantially equal to the distance between the first toe f1 and the fifth toe f5 in a healthy state. Accordingly, a first-toe-side step surface 2*d* (the right side in FIG. 4) facing the medial foot side x and a fifth-toe-side step surface 2*e* facing the lateral foot side y (the left side in FIG. 4) are formed on the front end 2*b* side of the raised part 2.

Further, the toe-side slope 2*f* of the raised part 2 is configured to have an inclination so as to be higher on a side to be in contact with the second toe f2 and lower on a side to be in contact with the fourth toe f4 in a cross section along the left and right direction. This configuration is based on the positional relationship of the second toe f2 to the fourth toe f4 in a healthy state.

Figure 7:
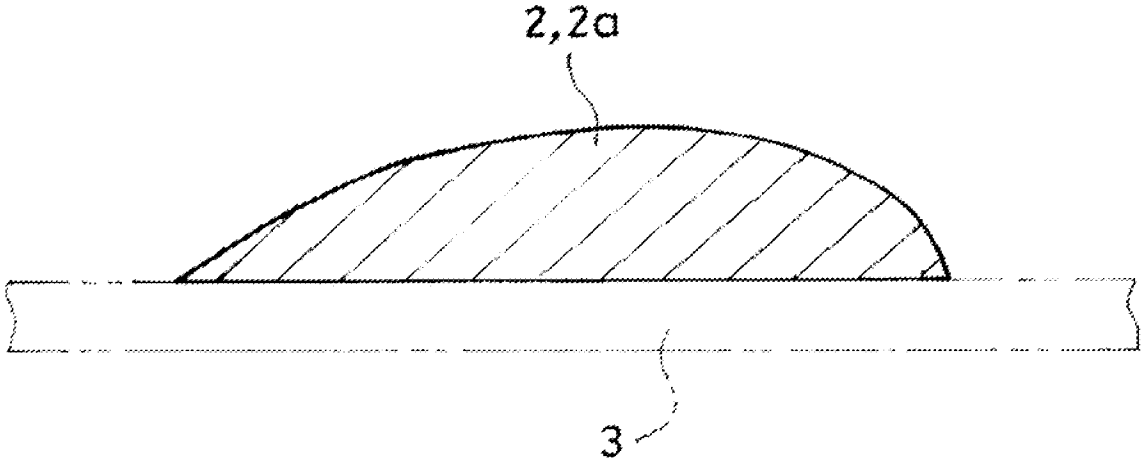
FIG. 7 is a configuration diagram of a cross section cut at the E-E line in FIG. 2.
Figure 8:
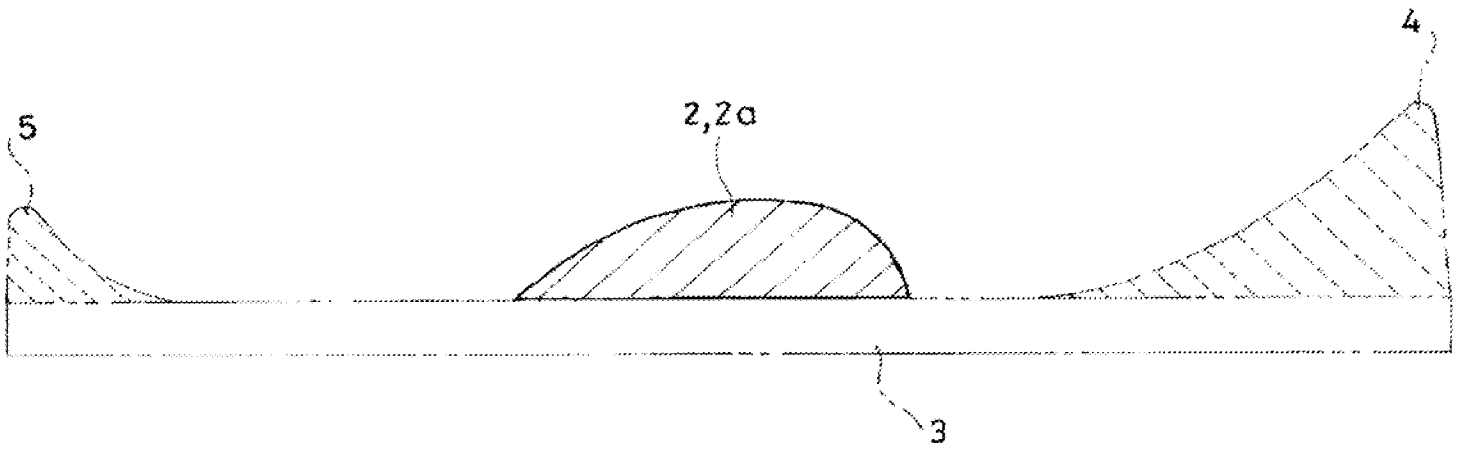
FIG. 8 is a configuration diagram of a cross section cut at the F-F line in FIG. 2.

The first toe-side step surface 2*d* and the fifth toe-side step surface 2*e* end slightly on a front side relative to a position z (see FIG. 2) approximately in the middle of the raised part 2 in the front and rear direction. These end positions roughly correspond to the positions of the metatarsophalangeal joints 100 of the first toe f1 and the fifth toe f5. On the rear side relative to the end positions of the first toe-side step surface 2*d* and the fifth toe-side step surface 2*e*, the raised part 2 is in a shape along an imaginary curved surface with the below side being the inside of the curve in a cross section along the left and right direction (FIG. 7, FIG. 8).

FIG. 10 illustrates the bone structure of a left foot placed on the sole contact body 1. The raised part 2 is located under the second toe f2 to the fourth toe f4 between the tips and the posterior ends 102*a* of the metatarsi 102 of the second toe f2 to the fourth toe f4. Hence, the positions of the metatarsophalangeal joints 100 and the proximal interphalangeal joints 104 of the second toe f2 to the fourth toe f4 can be lifted.

More specifically, the ridgeline 2*g* of the raised part 2 contacts the second toe f2 to the fourth toe f4 on the anterior end 103*a* side of their proximal phalanxes 103, and on the rear side relative to the ridgeline 2*g*, the upper surface of the raised part 2 contacts the second toe f2 to the fourth toe f4 on the posterior end 103*b* side of their proximal phalanxes 103. Thus, the second toe f2 to the fourth toe f4 are lifted at two locations, the anterior end 103*a* side and the posterior end 103*b* side of the proximal phalanxes 103 with the anterior end 103*a* side higher (see FIG. 11). Hence, the second toe f2 to the fourth toe f4 are also lifted at the positions of their proximal interphalangeal joints 104.

On the other hand, the raised part 2 is not present under the first toe f1 and the fifth toe f5, and no other structure for lifting the first toe f1 and the fifth toe f5 is provided, so that the first toe f1 and the fifth toe f5 are not lifted over their entire length. The first toe f1 and the fifth toe f5 contact the upper surface 3*a* of the base part 3 with their pads on both sides of the raised part 2.

Since the toe-side slope 2*f* is present under the tips of the second toe f2 to the fourth toe f4 (parts that are anterior relative to the proximal interphalangeal joints 104), the toe side of the second toe f2 to the fourth toe f4 is not in a floating state but is in a state where they can hold the toe-side slope 2*f* firmly even when the second toe f2 to the fourth toe f4 are lifted as described above (see FIG. 11).

The inventor has found that by enabling the lifted second toe f2 to fourth toe f4 to hold firmly as described above, the transverse arch Ac in which the first toe f1 and the fifth toe f5 are at lower positions can be effectively produced.

Since the length of the ligament 101 at the position of the metatarsophalangeal joints 100 does not change, the first toe f1 is pulled toward the lateral foot side y at the position of its metatarsophalangeal joint 100 and the fifth toe f5 is pulled toward the medial foot side x at its metatarsophalangeal joint 100 under the condition illustrated in FIGS. 10 and 11.

By lifting the second toe f2 to the fourth toe f4 not only at the positions of the metatarsophalangeal joints 100 but also at the positions of the proximal interphalangeal joints 104, a leverage-like force that lifts the second toe f2 to the fourth toe f4 on the tip side relative to their metatarsophalangeal joints 100 can be applied to the metatarsophalangeal joint 100 side of the second toe f2 to the fourth toe f4, causing a more effective change to the ligament 101.

Thus, the normal transverse arch Ac of a foot can be effectively produced.

A correction force acting on the fifth toe f5 synergistically acts as a correction force on the first toe f1, thereby achieving effective correction of hallux valgus.

On the tip side of the metatarsophalangeal joints 100, the first-toe-side step surface 2*d* contacts a side portion of the first toe f1 to apply a correction force to the first toe toward the medial foot side x, and the fifth-toe-side step surface 2*e* contacts a side portion of the fifth toe f5 to apply a correction force to the fifth toe f5 toward the lateral foot side y. These also contribute to correction of hallux valgus and digitus quintus varus.

It is preferable to form the first-toe-side step surface 2*d* so as to extend along a virtual vertical plane S2 that intersects a virtual horizontal plane S1 at an angle θ1 of 90 degrees to 60 degrees toward a center side 2*i* of the raised part 2, the horizontal plane S1 including left and right base portions 2*h* of the raised part 2 (a lower end of the first-toe-side step surface 2*d* and a lower end of the fifth-toe-side step surface 2*e*), and to form the fifth-toe-side step surface 2*e* so as to extend along a virtual vertical plane S3 that intersects the horizontal plane S1 at an angle θ2 of 90 degrees to 60 degrees toward the center side 2*i*.

The first-toe-side step surface 2*d* has a height h1. That is, the maximum value of the height h1 from the horizontal plane S1 to the top of the raised part 2 (the position of reference numeral 2*fb*) is preferably in the range of 8 mm to 11 mm, and the maximum value of a height h2 of the fifth-toe-side step surface 2*e* is preferably in the range of 4 mm to 7 mm.

Such configuration of the heights ensures that the first-toe-side step surface 2*d* contacts a side portion of the first toe f1 to apply a correction force toward the medial foot side x and the fifth-toe-side step surface 2*e* contacts a side portion of the fifth toe f5 to apply a correction force toward the lateral foot side y on the tip side relative to their metatarsophalangeal joints 100.

Figure 4:
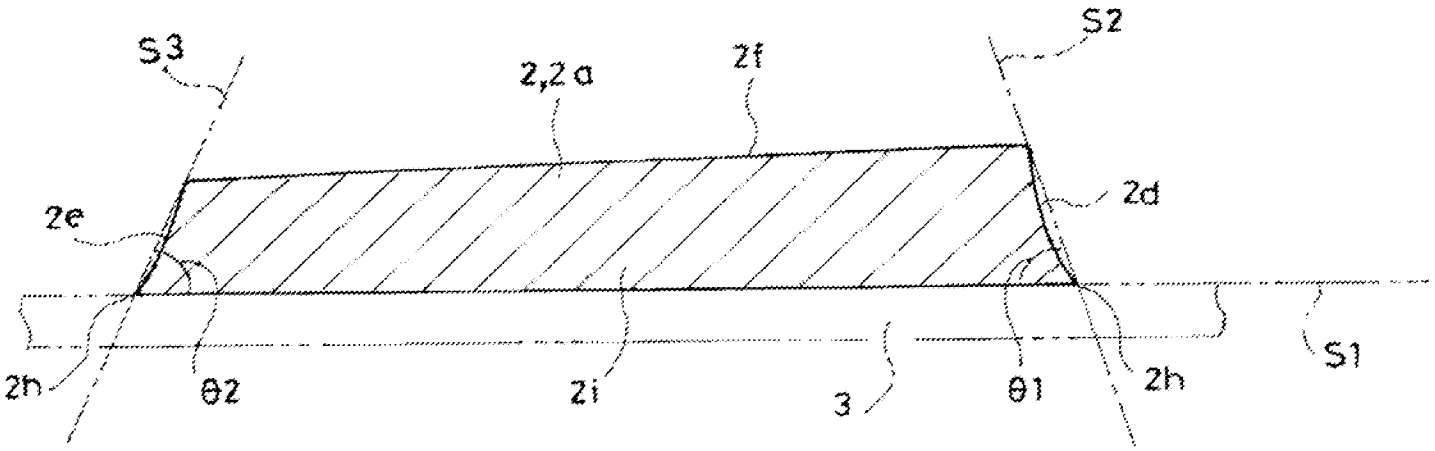
FIG. 4 is a configuration diagram of a cross section cut at the B-B line in FIG. 2.
Figure 5:
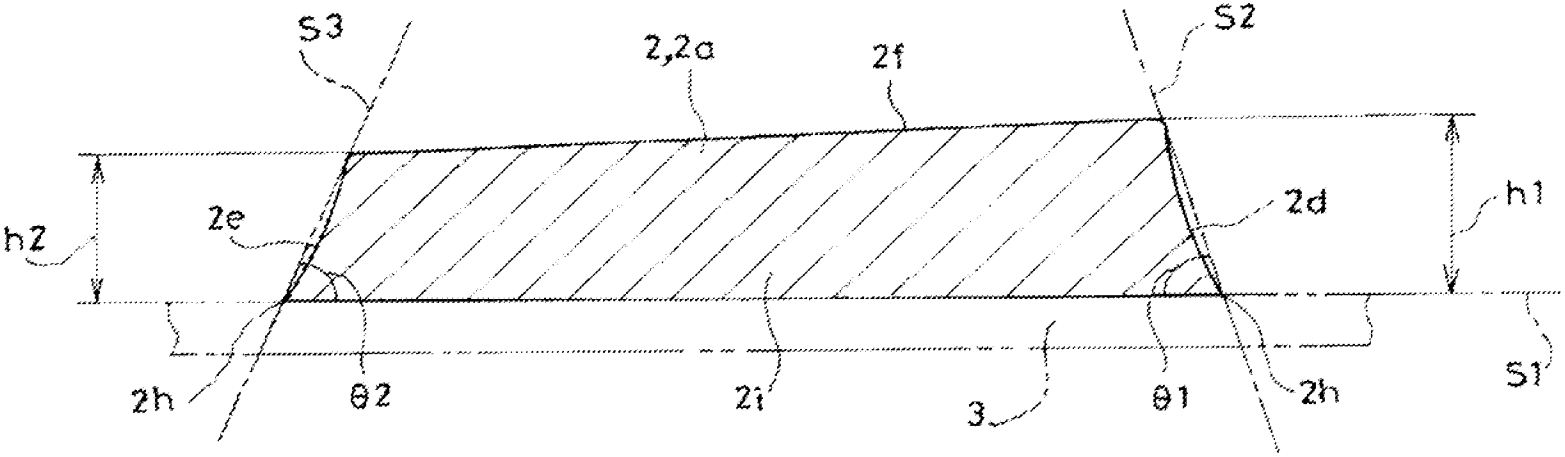
FIG. 5 is a configuration diagram of a cross section cut at the C-C line in FIG. 2.
Figure 6:
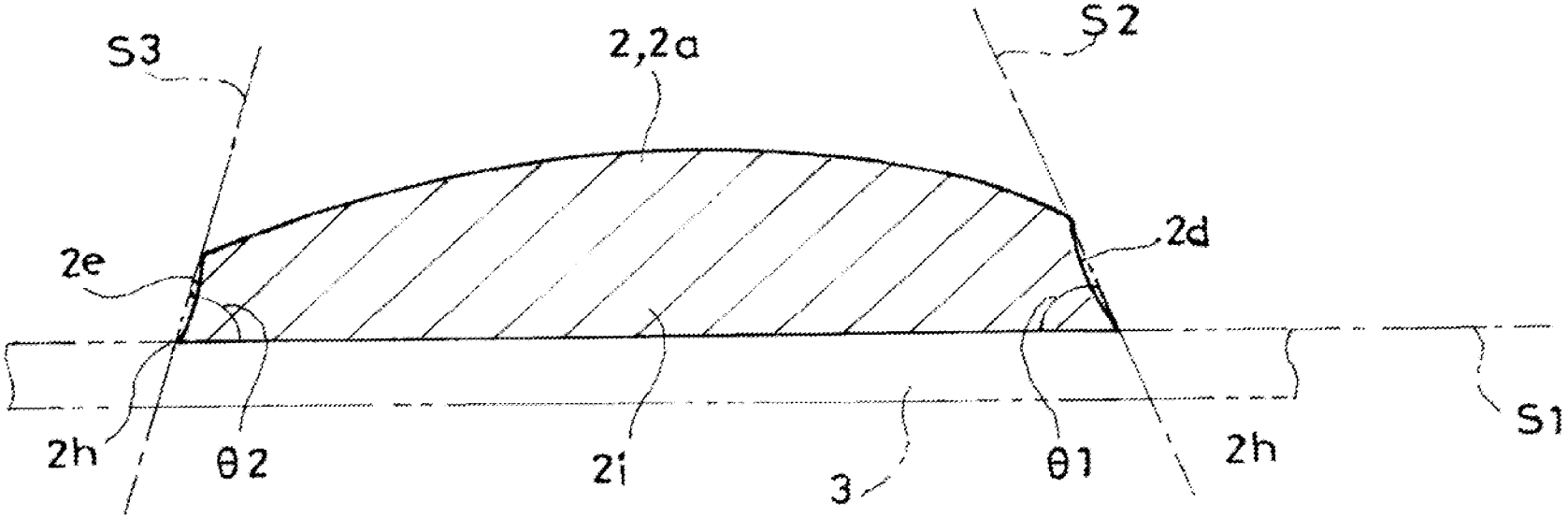
FIG. 6 is a configuration diagram of a cross section cut at the D-D line in FIG. 2.

In addition, as illustrated in FIGS. 4 to 6, the first-toe-side step surface 2*d* and the fifth-toe-side step surface 2*e* contact the side portion of the first toe f1 and the side portion of the fifth toe f5 on the tip side, respectively, in an area at least part of which is gently curved toward the center side 2*i* of the raised part 2.

Although not illustrated in the drawings, a sole contact body for a right foot is configured in a manner that is line symmetrical with the sole contact body 1 for a left foot described above.

FIGS. 12 to 18 illustrate a second example in which the configuration of the sole contact body 1 (the first example) described above is partially changed.

In the second example, a ridge-like part 2*m* protruding from the upper surface 2*k* of the raised part 2 and extending in the front and rear direction is formed at a position directly above the first-toe-side step surface 2*d*.

Figure 15:
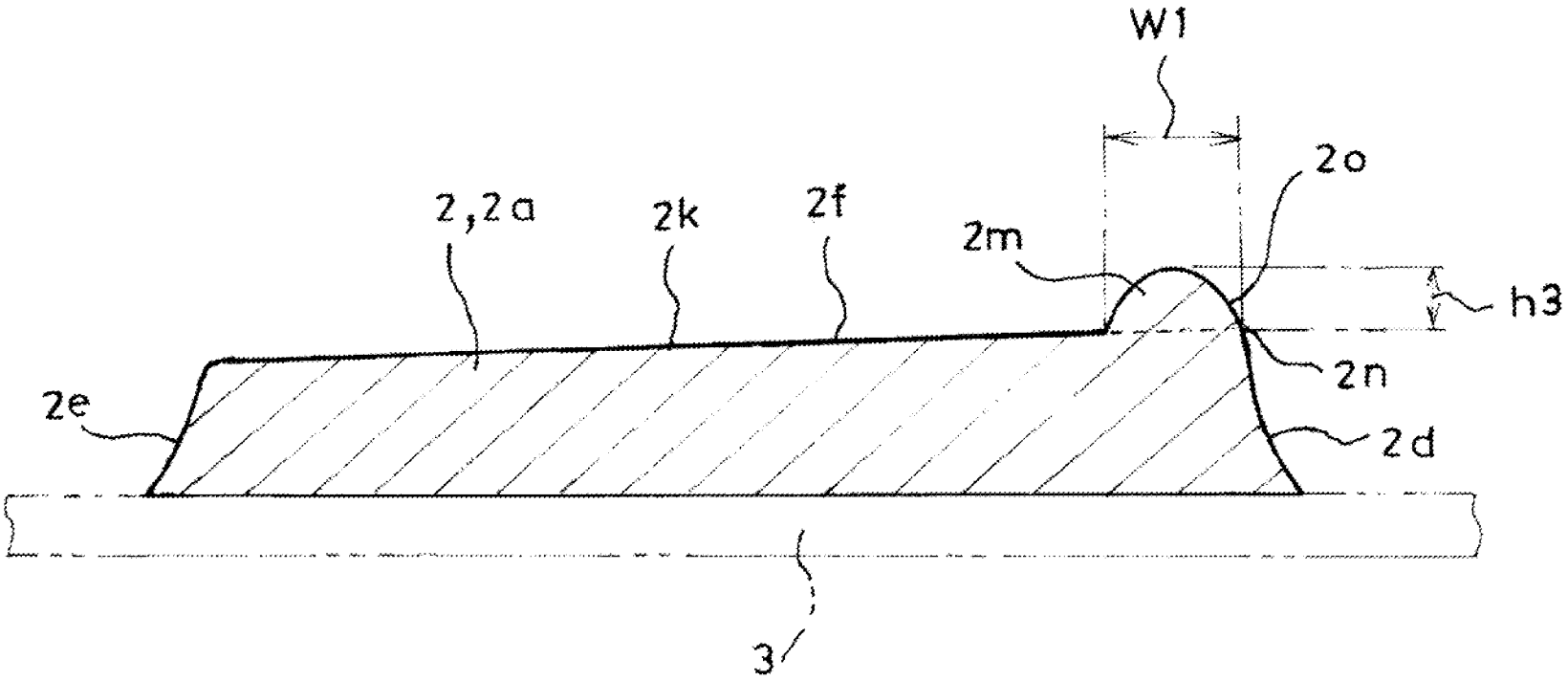
FIG. 15 is a configuration diagram of a cross section cut at the J-J line in FIG. 13.
Figure 16:
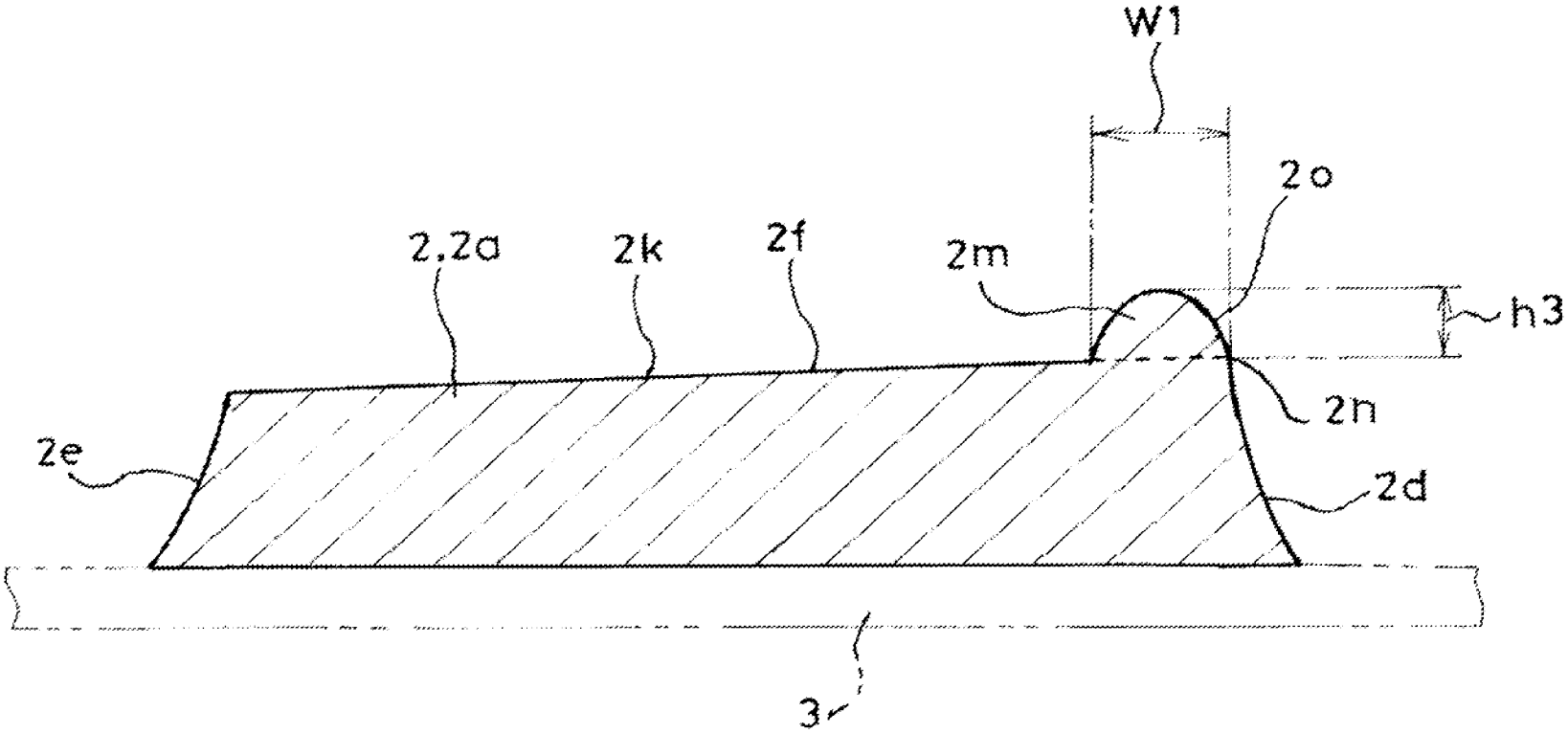
FIG. 16 is a configuration diagram of a cross section cut at the K-K line in FIG. 13.
Figure 17:
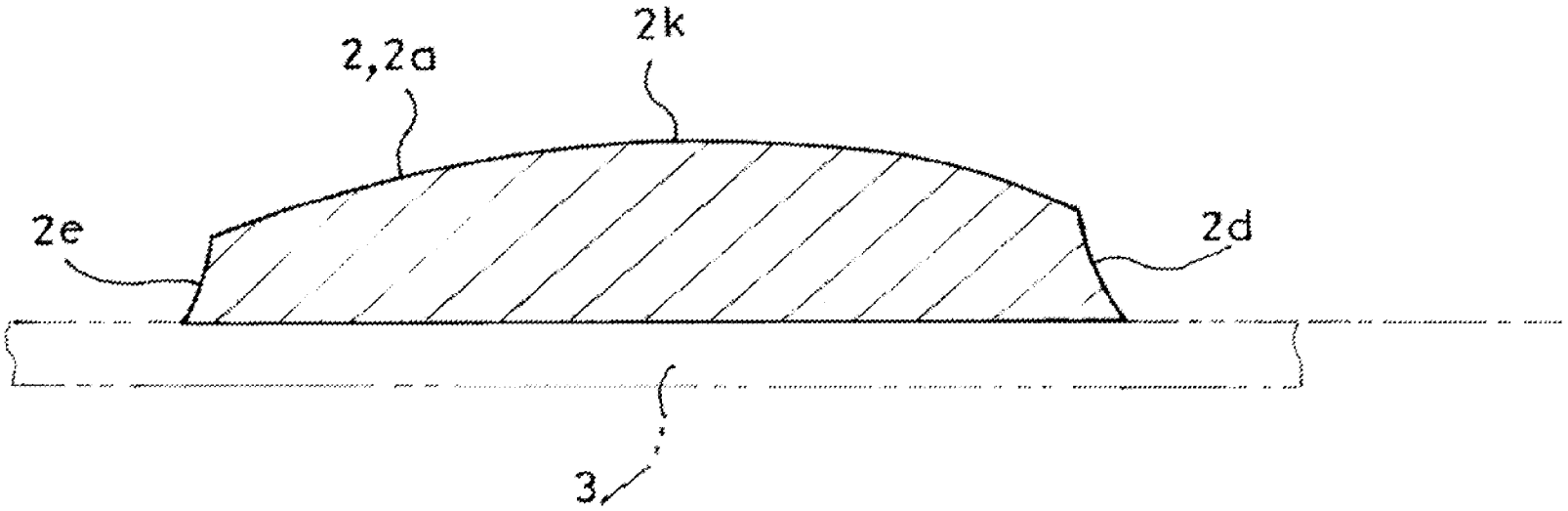
FIG. 17 is a configuration diagram of a cross section cut at the L-L line in FIG. 13.
Figure 18:
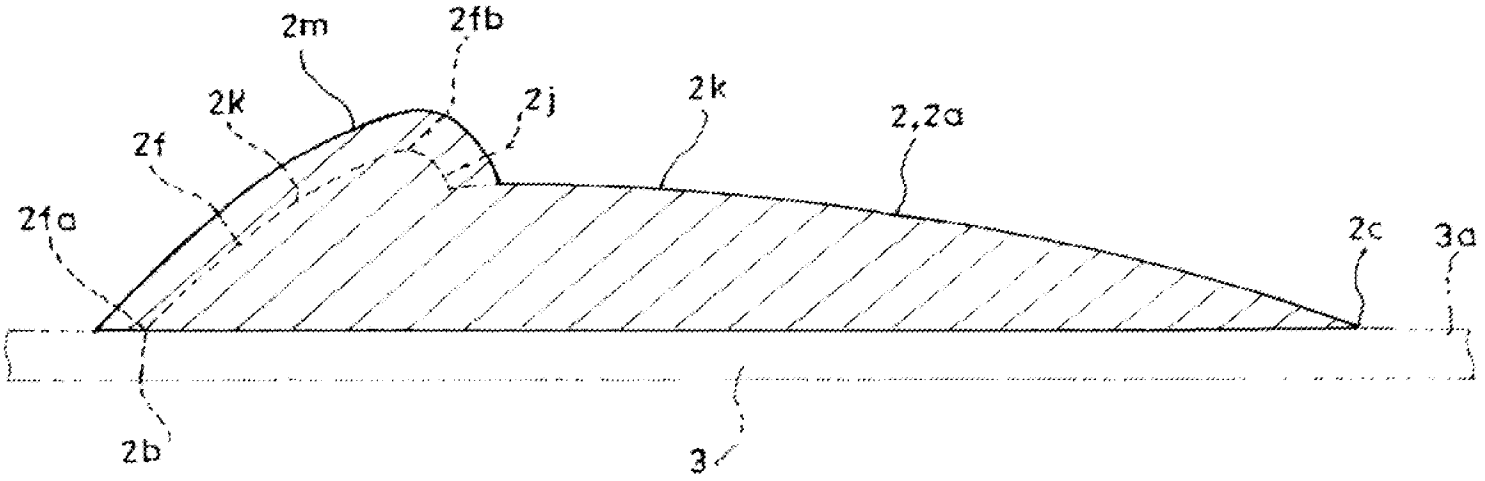
FIG. 18 is a configuration diagram of a cross section cut at the M-M line in FIG. 13.

In the illustrated example, the ridge-like part 2*m* is formed so as to trace an edge portion 2*n* extending along the front and rear direction of the raised part 2, at which the first-toe-side step surface 2*d* and the upper surface 2*k* of the raised part 2 are in contact when the ridge-like part 2*m* is not provided (see FIGS. 15 and 16).

In the illustrated example, the ridge-like part 2*m* is formed so as to extend between the front end 2*b* of the raised part 2 and a lower end of the step 2*j* behind the ridgeline 2*g* in an area directly above the first-toe-side step surface 2*d*.

Further, in the illustrated example, the ridge-like part 2*m* has a dome-shape outline in cross section perpendicular to its continuous direction at any position in the continuous direction.

The ridge-like part 2*m* is provided at a position where it can fit between the first toe f1 and the second toe f2. Due to the ridge-like part 2*m*, the second toe f2 can be positioned on the lateral foot side y of the ridge-like part 2*m* and the first toe f1 can be positioned off the raised part 2 on the medial foot side x of the ridge-like part 2*m* using the ridge-like part 2*m* as a guide by the tactile sense of the foot even in a shoe, of which inside cannot be seen from the outside, enabling it possible to put on the shoe without difficulty. In addition, the ridge-like part 2*m*, together with the first-toe-side step surface 2*d*, ensures that the tip side of the first toe f1 is kept in a sufficiently lowered state on the side of the raised part 2 without excessively lifting the second toe f2 to the fourth toe f4.

Considering these, the inventor has found that a protrusion dimension h3 (see FIGS. 15 and 16) of the ridge-like part 2*m* by which the ridge-like part 2*m* protrudes from the upper surface 2*k* of the raised part 2 is preferably in the range of 5 mm to 9 mm. The inventor has also found that a width w1 (see FIGS. 15 and 16) of the ridge-like part 2*m* is preferably in the range of 3 mm to 8 mm.

Further, it is preferable that a side surface 20 of the ridge-like part 2*m* facing the medial foot side x be flush with the first-toe-side step surface 2*d* (see FIGS. 15 and 16).

The rest of the configuration of the second example explained above is substantially the same as that of the sole contact body 1 (the first example) illustrated in FIGS. 1 to 11. The same components are denoted by the same reference numerals as those in FIGS. 1 to 11, and their explanation is omitted.

As a matter of course, the present disclosure is not limited to the embodiment described above but includes all embodiments that can achieve an object of the present disclosure.

LIST OF REFERENCE NUMERALS

1: Sole contact body
2: Raised part
2*d*: First-toe-side step surface
2*e*: Fifth-toe-side step surface
2*f*: Toe-side slope
f1: First toe
f2: Second toe
f3: Third toe
f4: Fourth toe
f5: Fifth toe
100: Metatarsophalangeal joint
104: Proximal interphalangeal joint

The invention claimed is:

1. A sole contact body, comprising:
a raised part, wherein
the raised part is configured to contact each of second, third, and fourth toes and lift the second, third, and fourth toes at positions of metatarsophalangeal joints and proximal interphalangeal joints thereof, and is configured to fit between a first toe and a fifth toe so as not to lift the first toe and the fifth toe over entire lengths thereof, and
the raised part includes:
a first-toe-side step surface configured to contact a side portion of the first toe on a tip side relative to a position of a metatarsophalangeal joint thereof;
a fifth-toe-side step surface configured to contact a side portion of the fifth toe on a tip side relative to a position of a metatarsophalangeal joint thereof, and
further comprising a toe-side slope configured to contact the second, third, and fourth toes on a tip side relative to the metatarsophalangeal joints and the proximal interphalangeal joints thereof,
wherein the first-toe-side step surface and the fifth-toe-side step surface each form a corner with the toe-side slope.

2. The sole contact body according to claim 1, further comprising:
a space formed on a medial foot side of the raised part, in which the first toe is accommodated without being lifted; and
a space formed on a lateral foot side of the raised part, in which the fifth toe is accommodated without being lifted.

3. The sole contact body according to claim 1, wherein
the first-toe-side step surface is formed so as to extend along a vertical plane that intersects a horizontal plane at an angle of 90 degrees to 60 degrees toward a center side of the raised part, the horizontal plane including left and right base portions of the raised part, and the fifth-toe-side step surface is formed so as to extend along a vertical plane that intersects the horizontal plane at an angle of 90 degrees to 60 degrees toward the center side.

4. The sole contact body according to claim 1, wherein
the first-toe-side step surface has a maximum height of 8 mm to 11 mm, and the fifth-toe-side step surface has a maximum height of 4 mm to 7 mm.

5. The sole contact body according to claim 1, wherein the first-toe-side step surface and the fifth-toe-side step surface contact the side portion of the first toe and the side portion of the fifth toe on the tip side, respectively, in an area at least part of which is gently curved toward a center side of the raised part.

6. The sole contact body according to claim 1, wherein a portion of the raised part on a rear side relative to the toe-side slope is configured to gradually decrease in height and left-right width toward the rear side.

7. The sole contact body according to claim 1, further comprising a ridge part formed at a position directly above the first-toe-side step surface, the ridge part protruding from an upper surface of the raised part and extending in a front and rear direction.

8. The sole contact body according to claim 7, wherein the ridge part has a width of 3 mm to 8 mm and protrudes from the upper surface of the raised part by 5 mm to 9 mm.

9. The sole contact body according to claim 7, wherein a side surface of the ridge part facing a medial foot side is flush with the first-toe-side step surface.

* * * * *